US007144201B2

(12) United States Patent
DeArmond, Jr.

(10) Patent No.: US 7,144,201 B2
(45) Date of Patent: Dec. 5, 2006

(54) STRUCTURE AND METHOD FOR SUPPORTING HEADSTONES AND OTHER STONELIKE OBJECTS

(76) Inventor: Thomas H. DeArmond, Jr., 18381 Boones Ferry Rd. NE., Hubbard, OR (US) 97032

( * ) Notice: Subject to any disclaimer, the term of this patent is extended or adjusted under 35 U.S.C. 154(b) by 0 days.

(21) Appl. No.: 10/810,959

(22) Filed: Mar. 25, 2004

(65) Prior Publication Data

US 2005/0214077 A1 Sep. 29, 2005

(51) Int. Cl.
*E02D 29/02* (2006.01)
*A01G 1/08* (2006.01)

(52) U.S. Cl. ..... 405/286; 47/33; 52/656.8; 248/346.5

(58) Field of Classification Search ..... 405/284–286, 405/262, 16, 15, 21, 30, 302.4; 52/102, 103, 52/421, 656.8, 663; 47/32.4, 32.7, 32.6, 47/32.8, 33; 248/346.5
See application file for complete search history.

(56) References Cited

U.S. PATENT DOCUMENTS

| | | | | |
|---|---|---|---|---|
| 70,076 | A | 10/1867 | Dean | |
| 863,786 | A * | 8/1907 | Curtlett | 52/715 |
| 1,071,091 | A | 8/1913 | Rogers | |
| 1,088,417 | A * | 2/1914 | Harp | 52/715 |
| 1,905,176 | A | 4/1933 | Kieckhefer | |
| 1,951,132 | A * | 3/1934 | Cox | 264/266 |
| 2,315,180 | A | 3/1943 | Arthur | |
| 2,315,448 | A | 3/1943 | Nagin et al. | |
| 2,369,412 | A | 2/1945 | Ruppel | |
| 2,652,133 | A * | 9/1953 | Leigh | 52/658 |
| 2,876,628 | A | 3/1959 | Dixon, Jr. | |
| 2,899,775 | A | 8/1959 | Partin | |
| 2,912,910 | A | 11/1959 | Wilson et al. | |
| 3,118,522 | A | 1/1964 | Wetterlin | |
| 3,378,942 | A | 4/1968 | Diamond et al. | |
| 3,438,312 | A | 4/1969 | Becker et al. | |
| 3,597,928 | A | 8/1971 | Pilaar | |
| 3,604,172 | A | 9/1971 | Matvey | |
| 3,650,072 | A | 3/1972 | Matvey | |

(Continued)

*Primary Examiner*—Michael Safavi
*Assistant Examiner*—Gay Ann Spahn
(74) *Attorney, Agent, or Firm*—Birdwell & Janke, LLP

(57) ABSTRACT

A structure and method for supporting stonelike objects on soil. The structure comprises a base, at least two sets of a plurality of tabs disposed on the base at respective opposing edges thereof and oriented substantially perpendicular thereto, and a plurality of struts disposed on the base between and attached to respective tabs of the two sets of a plurality of tabs so as to brace the tabs and receive stonelike objects for support thereof. The base has a substantially planar frame and intersecting crossmembers connecting the edges of the frame, is substantially rectangular, and has openings for water drainage. The tabs are separated by substantially V-shaped spaces. The struts are disposed substantially parallel to one another, are relatively tall in comparison with their width, and at least one of the struts spans the space between the two sets of a plurality of tabs. Connectors are provided for attaching adjoining units to each other, the connectors being adapted to allow a plurality of adjacent units to be connected and a multiunit structure so assembled to be rolled up. The method comprises providing a support structure having a base whereon are disposed at least two sets of a plurality of tabs at respective opposing edges thereof, the tabs being oriented substantially perpendicular to the base, placing the support structure on a support surface, and placing a stonelike object on the support structure between the two sets of tabs.

14 Claims, 4 Drawing Sheets

U.S. PATENT DOCUMENTS 3,758,999 A 9/1973 Matvey
3,903,702 A 9/1975 Appleton
3,990,247 A 11/1976 Palmer
4,008,548 A 2/1977 Leclerc
4,067,197 A 1/1978 Ritter
4,091,587 A * 5/1978 Depka ..... 52/421
4,111,585 A 9/1978 Mascaro
4,118,892 A * 10/1978 Nakamura et al. ..... 47/65.9
4,329,392 A 5/1982 Bronner
4,437,281 A * 3/1984 See et al. ..... 52/309.1
4,610,568 A 9/1986 Koerner
4,621,942 A 11/1986 Hill
4,749,302 A * 6/1988 DeClute ..... 404/37
4,798,498 A 1/1989 Hallberg
4,963,054 A * 10/1990 Hayashi ..... 404/34
5,006,011 A * 4/1991 Hiyashi ..... 404/37
5,102,048 A 4/1992 Bohnhoff
5,123,778 A 6/1992 Bohnhoff
5,250,340 A 10/1993 Bohnhoff
5,263,289 A * 11/1993 Boyd ..... 52/220.2
5,323,575 A * 6/1994 Yeh ..... 52/177
5,400,544 A * 3/1995 Wien ..... 47/33
5,406,745 A * 4/1995 Lin ..... 471/1.01 F
RE35,006 E * 8/1995 Ripley et al. ..... 47/65.9
5,437,127 A 8/1995 Ha
5,845,436 A 12/1998 Nota
5,992,106 A * 11/1999 Carling et al. ..... 52/177
6,199,327 B1 3/2001 Krawczyk
6,253,487 B1 * 7/2001 Yoshida et al. ..... 47/33
6,266,921 B1 * 7/2001 Keskilohko ..... 47/86
6,467,224 B1 * 10/2002 Bertolini ..... 52/177
6,526,693 B1 * 3/2003 Cochran ..... 47/66.5
6,751,912 B1 * 6/2004 Stegner et al. ..... 52/177
6,802,159 B1 * 10/2004 Kotler ..... 52/177
D499,189 S * 11/2004 Collison ..... D25/62
2002/0073915 A1 6/2002 Howard
2003/0154663 A1 * 8/2003 Nelson ..... 52/103

* cited by examiner

Fig. 5
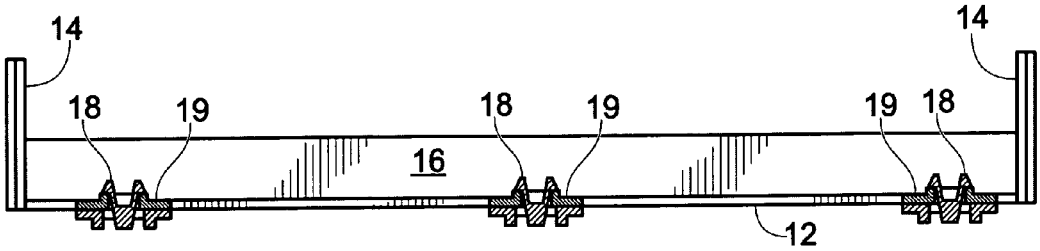
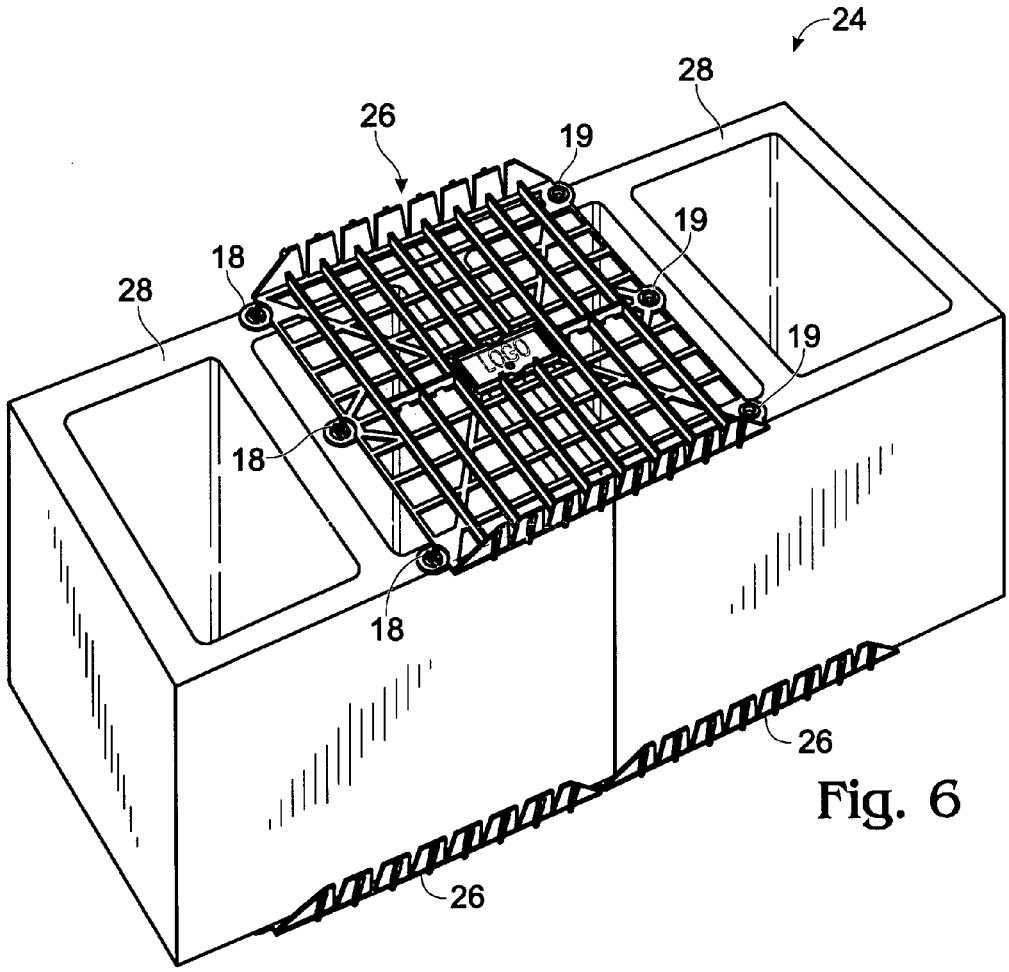
Fig. 6

STRUCTURE AND METHOD FOR SUPPORTING HEADSTONES AND OTHER STONELIKE OBJECTS

BACKGROUND OF THE INVENTION

The present invention relates to support structures for stonelike objects such as, for example, headstones and other grave markers, and retaining walls.

Operators of cemetery facilities, faced with increasing labor costs, are seeking to make cemetery maintenance as readily amenable to mechanical means as possible. These businesses also seek to maintain the attractive appearance of cemeteries, which are usually landscaped with lawns and plantings. Relatives of deceased persons are also concerned about the maintenance of grave sites as well as the initial cost of headstones.

Some cemeteries that have been in existence for long periods of time tend to have grave-markers and headstones which have sunk into the soil, often at irregular angles. As well as producing an unattractive and irregular appearance, markers that are tilted, sunken, partially buried, or protruding at various angles, dramatically increase maintenance costs, as such markers must have grass and other vegetation cleared from around them by hand due to their irregularity, rather than by use of power tools. For instance, a horizontally disposed marker, such as is required more and more by cemeteries due to lawn maintenance issues, can be readily mowed over if it lies flat and flush with the ground surface. However, if the stone sinks irregularly into the ground, a portion may protrude enough to be damaged by a mower blade set at a standard height, thus requiring hand trimming of the area.

Furthermore, as stones sink into the ground, the horizontal surfaces with memorial indicia tend to become covered with soil and vegetation, leading to a decrepit look and obscuring the indicia of the interred person. The corrosive nature of some soils acting on the bronze or marble used in many grave markers can also bring about unattractive degradation of the materials of construction of the marker.

The materials of which most headstones and grave markers are made aggravate the problem due to their heaviness and density. The attributes that people seek in grave markers, notably durability and longevity, are largely found in heavier materials such as stone, cement, metal, or even brick. Few headstones are made of lightweight materials, such as wood, plastic or aluminum, which might be easier to support on soft graveyard soils. Rather, the weight of the marker material combined with the relatively small footprint on the soft soil tends to promote sinkage and displacement of the marker.

The need to support heavy stonelike objects on soil is also encountered in other applications, such as in parks where landscaping features such as retaining walls, statues or fountains are placed on relatively soft soils. Features such as relatively low landscaping walls are used both in cemeteries and in parks. Golf courses are another venue where sometimes heavy objects such as benches or statuary must rest on relatively soft soils.

The construction of retaining walls made of concrete block presents particular challenges. Because they are usually held in place by gravity, the provision of trenching and drainage is needed to provide stability. Among other things, this is labor intensive.

For these and other reasons, it is desirable to provide a structure adapted for supporting head stones, grave-markers, retaining walls, statuary, benches, and other heavy stonelike objects that must rest on the relatively soft soils of cemeteries, park lawns, and other relatively unstable surfaces. Such a structure should not only evenly distribute the weight of the heavy stonelike object over the area of ground that it covers and itself be strong enough to avoid being crushed or deformed by the object it is supporting, but it should also provide for proper drainage around the object being supported and not itself collect water. Otherwise, water pooling around the object being supported could not only cause corrosion but also could add to the already substantial weight being supported.

Many attempts have been made to provide support for grave-markers and other stonelike objects in the ground, but the foregoing concerns have not heretofore been adequately addressed. For example, Matvey, U.S. Pat. No. 3,604,172 describes a structure for supporting a single grave-marker. The structure has a rectangular frame with a horizontal base portion defining a relatively large opening, a transition portion having a vertical lower portion and a sloping upper portion, and an upper portion which is horizontal and outwardly directed. The grave marker rests within the frame and is supported around its edges by the horizontal base portion of the support. Thus, the grave-maker receives no support except for a relatively narrow band around its edges and its bottom is in direct contact with earth or a filling material. Drainage occurs only through the bottom of the unit, as no provision is made for drainage laterally through the frame.

Matvey, U.S. Pat. No. 3,758,999 describes a protective structure for a single grave-marker that is designed to prevent undesired displacement of the marker and inhibit adjacent vegetation. However, the Matvey structure is actually a three-part assembly that requires pouring a concrete slab to support a frame and provide anchor bolts for the marker. Also, water drainage is provided by relatively small circular holes which may become plugged from debris such as grass clipping, portions of dead leaves, or particles of dirt carried downward by the water flow.

Nota, U.S. Pat. No. 5,845,436 discloses another example of a grave-marker support device that includes a basin which conforms substantially to the shape of the grave-marker, and which is equipped with flanges which are reinforced with a rigid curled-under edge or lip. The basin, whose bottom is otherwise solid, has grooves to channel water to an outlet to facilitate drainage through a central hole. Again, the drainage hole is shown to be relatively small in diameter compared to the dimensions of the basin and may become plugged with debris carried by water flow.

In addition, all of the above-referenced devices employ lips which rest upon the top surface of the ground surrounding the grave-marker, thereby providing a visibly obtrusive barrier to the growth of grass.

In view of the above, there is a need for an improved support structure that addresses the above-mentioned deficiencies in structures for stably supporting headstones and other stonelike objects on the ground.

SUMMARY OF THE INVENTION

The present invention addresses the foregoing concerns by providing a support structure for stonelike objects on the ground, comprising a base, at least two sets of a plurality of tabs disposed on the base at respective opposing edges thereof and oriented substantially perpendicular thereto, and a plurality of struts disposed on the base between and attached to respective tabs of said two sets of a plurality of tabs so as to brace the tabs and receive stonelike objects for support thereof. Preferably, the base has a substantially planar frame and intersecting crossmembers connecting the edges of the frame, is substantially rectangular, and has openings for water drainage. Also preferably, the tabs within the sets of a plurality of tabs are separated by substantially V-shaped spaces and the struts are disposed substantially parallel to one another, are relatively tall in comparison with their width, and at least one of the struts spans the space between the two said sets of a plurality of tabs.

Connectors may be provided for attaching adjoining units to each other, the connectors preferably being adapted to allow a plurality of adjacent units to be connected and a multiunit structure so assembled to be rolled up. Preferably, the connectors comprise snaps.

The invention also provides a method for supporting stonelike objects on soil, providing a support structure comprising a base whereon are disposed at least two sets of a plurality of tabs at respective opposing edges thereof, the tabs being oriented substantially perpendicular to the base, placing the support structure on a support surface, and placing a stonelike object on the support structure between the two sets of tabs.

In particular, the stonelike object may be a headstone or a component of a retaining wall.

It is to be understood that this summary is provided as a means of generally determining what follows in the drawings and detailed description of the invention and is not intended to limit the scope of the invention. Moreover, the objects, features and advantages of the invention will be more fully understood upon consideration of the following detailed description of the invention taken in conjunction with the accompanying drawings.

BRIEF DESCRIPTION OF THE DRAWINGS

FIG. 5 shows a cross-section of connectors of two adjacent support structures when connected.

FIG. 6 shows a perspective view of the support structure of the present invention used to support a retaining wall of concrete block.

DETAILED DESCRIPTION OF A PREFERRED EMBODIMENT

Figure 1A:
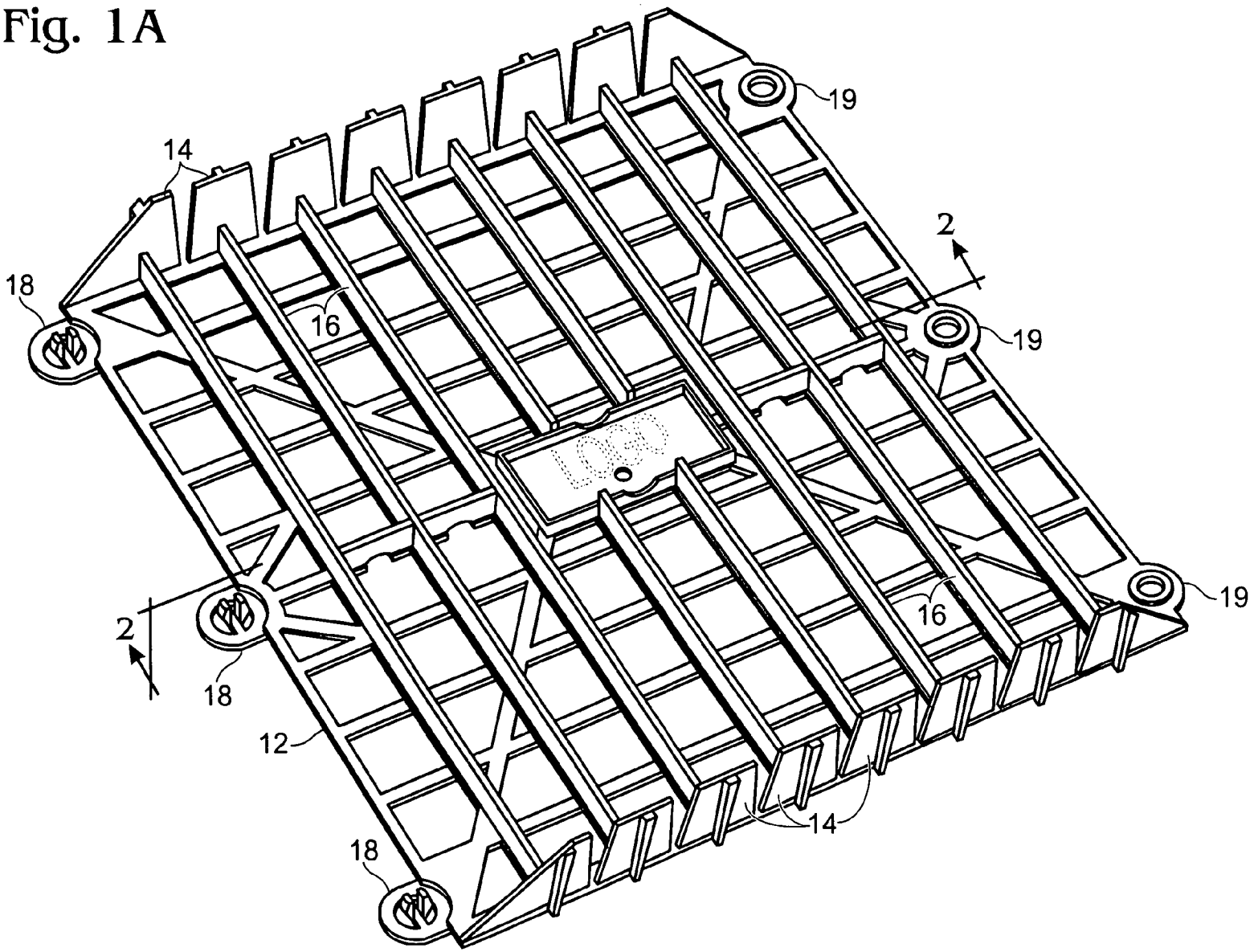
FIG. 1A shows a top perspective view of a preferred embodiment of a support structure according to the present invention.

FIG. 1A shows a preferred embodiment of the present invention, comprising a base 12, two sets of pluralities of tabs 14 disposed at respective opposing edges thereof, a plurality of struts 16 spanning the frame, and mating connectors 18 and 19. The base, which is preferably substantially planar, is adapted to lie on the soil slightly below the surface of the ground when used to support a headstone. When used to support other stonelike objects, such as a retaining wall, the base may be placed on the surface of the soil or even on another stonelike object. The base, which is preferably rectangular but is not restricted to that shape, has tabs arranged in sets along two opposite sides. However, other arrangements are consistent with the principles of the invention; for example a hexagonal base adapted for supporting a hexagonal structure that has tabs along two sets of opposing sides, or four total sides, might also be used. In the rectangular base of the preferred embodiment of FIG. 1A, the tabs are shown as disposed along the two longer sides of the base, but they may be disposed along the two shorter sides of the base without departing from the principles of the present invention.

Preferably, the tabs 14 of the preferred embodiment are affixed to the base 12 along its outer edge as shown in FIG. 1A, but they could be affixed to the base interior to the outer edges as well. It is also consistent with the present invention that a significant portion of the base member may project beyond the line of the tabs to further stabilize the structure in the soil or to inhibit vegetative growth immediately adjacent to the structure.

Figure 2:
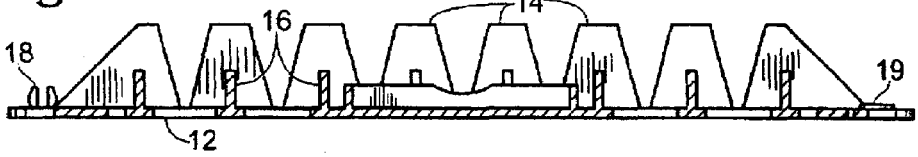
FIG. 2 shows a cross-section view of the preferred embodiment of FIG. 1A taken along line 2—2 thereof.

The tabs 14 are disposed substantially perpendicular to the base 12 so as the base lies in a horizontal position on the soil, the tabs project vertically upwardly. The tabs as shown in FIGS. 1A and 2 are of a trapezoidal shape, tapering inwardly from the point where they are affixed to the base upwardly to a blunt, flat tip. This not only provides for lateral water flow through the gaps between the tabs so as to minimize water buildup under the stonelike object that the structure supports, but also serves to facilitate rolling up a plurality of units of the structure into a relatively tight radius for transportation and storage. However it is to be recognized tabs of other shapes such as, for example, rectangular, triangular, hemi-ellipsoidal, could also be used to provide adequate results. The tabs are shown in FIGS. 1A and 2 as touching adjacent tabs at their lower end, but they may be spaced apart at their lower end as well, particularly to increase the rate of lateral water drainage where desired.

As shown in FIG. 1A, most of the struts 16 are affixed at their ends to respective tabs 14 on the two sides of the base 12, and span the short dimension of the rectangular base 12. However, some do not span the entire distance. Thus, the struts might have varying lengths and attach only to one tab at one side. For example, the base could be hexagonal, with tabs disposed on two sets of opposing edges, and the struts could attach to respective tabs and span all or part of the distance across the hexagonal base. The struts are adapted to provide support for a stonelike object that will rest thereon, and their affixation to the base and to the tabs both provides the struts with sufficient rigidity to do so and braces the tabs.

FIG. 2 shows the struts as being substantially rectangular in cross-section, with the length in the vertical dimension, i.e., the dimension perpendicular to the plane of the base, being longer than that in the cross-sectional horizontal dimension. However, it is consistent with the present invention for the struts to have other shapes, including but not limited to solid prismatic forms such as triangular or hemicylindrical (hemicircular in cross-section).

Figure 1B:
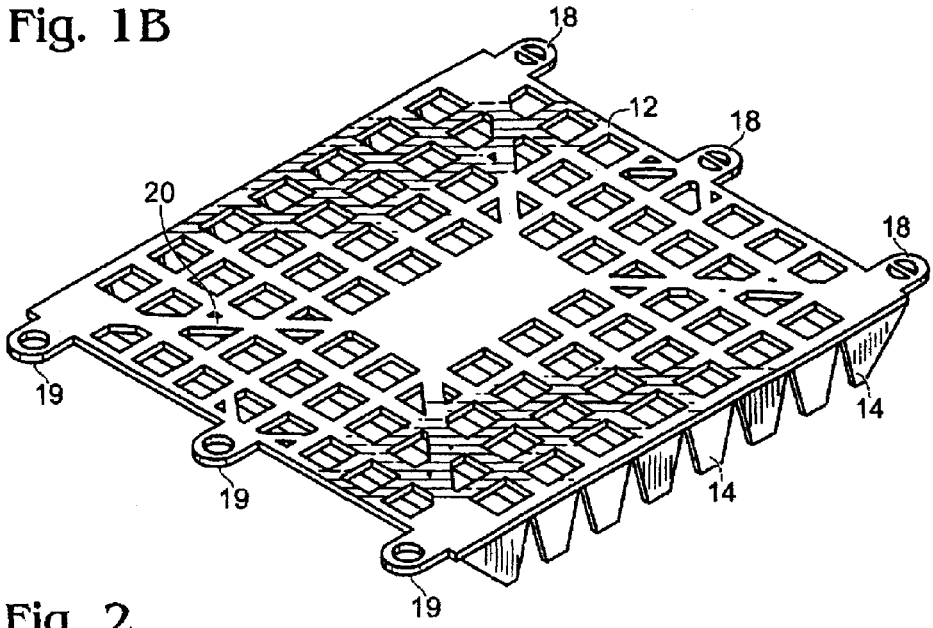
FIG. 1B shows a bottom perspective view of the preferred embodiment of FIG. 1A, showing a base comprising a frame and intersecting crossmembers.

Turning to FIG. 1B, which shows a view of the base from the lower side, the base is preferably reinforced by sets of intersecting crossmembers 20, on which the struts (not shown) are also disposed and to which they may be attached as well. The intersecting crossmembers resist lateral tension, while the struts resist vertical compression, thereby providing a particularly stable structure. FIG. 1B shows a base with three sets of substantially parallel crossmembers intersecting each other, but other arrangements of intersecting crossmembers could also be used.

The support structure, either with or without sets of intersecting crossmembers, provides for good drainage downward, as there is a large area open to the soil below with no small openings susceptible to being plugged by dirt or debris. Also, the openings between the tabs 14 provide for lateral drainage, the relatively large gaps again providing for an unimpeded flow of water away from the support structure and the object being supported.

Figure 3:
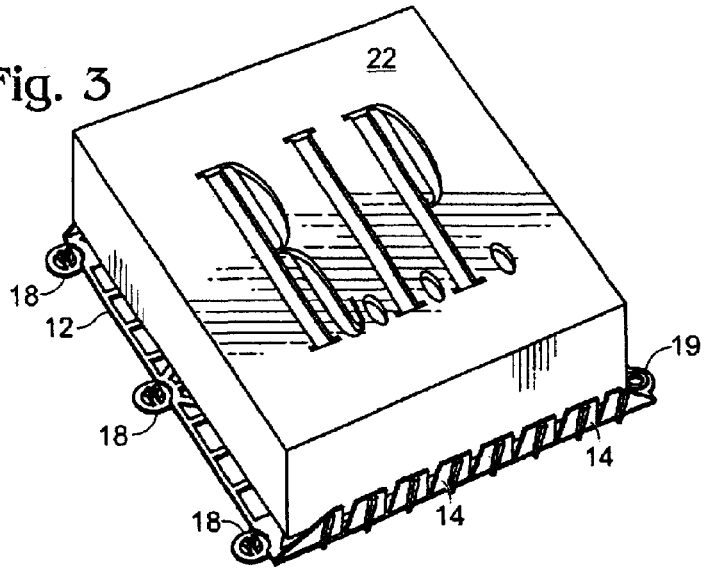
FIG. 3 shows a perspective view of the preferred embodiment of FIG. 1A bearing a headstone.

FIG. 3 shows the support structure bearing a horizontally disposed grave marker 22. The stonelike marker lies on the struts which transmit the weight of the load to the base 12 with or without intersecting crossmembers, thus dispersing and evening the load on the subjacent soil. The marker is restrained against lateral movement by the tabs 14. In FIG. 3, the base 12 extends outwardly beyond the tabs, which is adapted to provide additional support and dispersion of the load, and also may be used to suppress adjacent vegetative growth. Also, drainage may be enhanced by emplacing porous materials such as sand or gravel over this portion of the base, so as water drains out from the area immediately around the base of the marker 22 it may freely diffuse into the surrounding medium.

Figure 4:
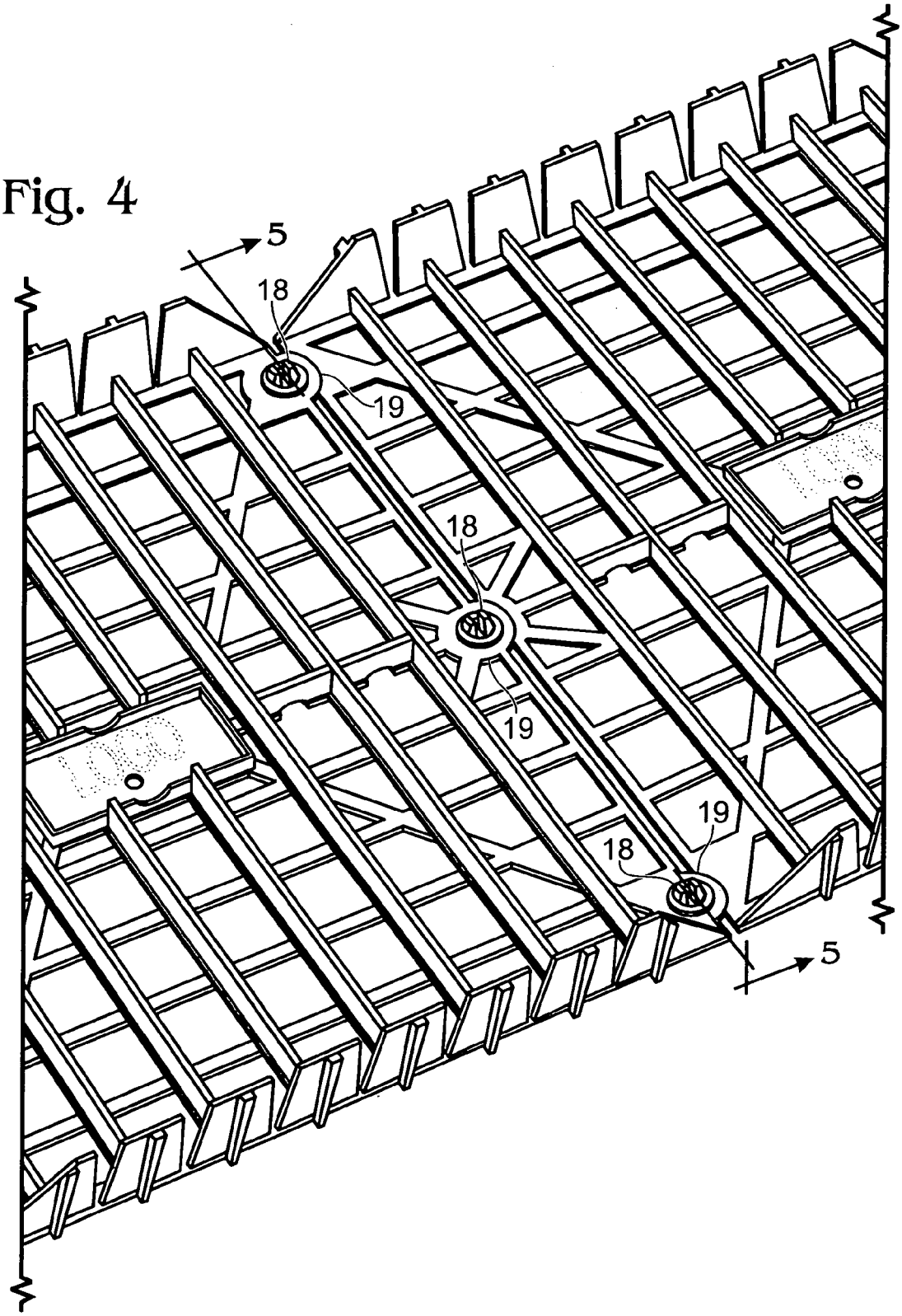
FIG. 4 shows a perspective view of two support structures joined together by connectors.

Returning to FIG. 1A, connectors 18 are preferably disposed on the edges of the base 12. As shown in FIG. 4, these connectors may be used to attach adjacent support structures together to form a row. Connectors may also be disposed on more than two sides to allow connection of adjacent units to form a mat. The connector arrangement shown in FIG. 4, where the connectors 18 are located at the two ends of a rectangular base, allows for assembly of a linearly-disposed plurality of support structures comprising a row. This may be of particular utility in providing subjacent support to an area where a corresponding row of grave markers or other stonelike objects, such as a retaining wall, is to be emplaced. Such a linear assembly of multiple support units may be pre-assembled then rolled into a cylindrical roll for facilitating storage, transport and subsequent emplacement.

FIG. 5 shows a cross-section of the two connected structures illustrated in FIG. 4, where connectors are of a snapping variety when a compressible pin 18 is inserted through an opening 19, whereupon expansion of the head of the pin locks the units in place. However, other types of connectors, such as interlocking hinges, could be used to connect the structures together, without departing from the principles of the invention. In any case, it is preferable that the connectors permit the units to rotate with respect to one another so that they both can adjust for variations in ground height and roll up for storage and transportation.

Turning to FIG. 6, a retaining wall 24 may be supported by units 26 of the present invention. In this case the retaining wall comprises concrete blocks 28 disposed on support units 26, which may be placed on the ground. This permits water to flow both downwardly through the retaining wall, and laterally outward at the bottom of the wall, so as not to undermine the foundation thereof. Thus, the present invention may be used to alleviate the need to provide trenching and drainage in the construction of a retaining wall. In addition, support units 26 according to the present invention may be placed between layers of concrete blocks so as to hold the blocks in place and allow water to flow therethrough so as not to build up hydrostatic pressure behind the wall. It is to be recognized that other stonelike members could be used in this application besides concrete blocks.

Thus the present invention comprises an apparatus or system which provides subjacent support for heavy objects of various types, sizes, and shapes which rest on relatively soft soils prone to subsidence, where provision is made for both vertical and lateral drainage, connection of units to one another, and ease of storage, shipment and emplacement. Whether used to support a headstone, a retaining wall, or some other heavy object, the present invention may be used to increase the load-bearing capability of the soil.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow. It will doubtless be obvious to those of ordinary skill in the art that there are other embodiments employing these principles that are not described in detail herein.

The invention claimed is:

1. A support structure for stonelike objects on soil, comprising:

a base, said base being bounded by an upper surface and a lower surface;

at least two sets of a plurality of tabs, said tabs being disposed above said upper surface of said base at respective opposing edges thereof and being oriented substantially perpendicular said upper surface of said base; and a plurality of substantially parallel struts disposed above said upper surface of said base substantially perpendicular to said opposing edges, and disposed between and attached to respective tabs of said two sets of a plurality of tabs so as to brace the tabs and receive stonelike objects for support thereof.

2. The support structure of claim 1, wherein said base comprises a substantially planar frame and intersecting crossmembers connecting the edges of the frame.

3. The support structure of claim 2, wherein the base is substantially rectangular and has openings for water drainage, tabs within said sets of a plurality of tabs are separated by substantially V-shaped spaces, and the struts are disposed substantially parallel to one another and are relatively tall in comparison with their width.

4. The support structure of claim 3, wherein at least one of the struts spans the space between the two said sets of a plurality of tabs.

5. The support structure of claim 3, further comprising connectors for attaching adjoining support structures to each other, the connectors being adapted to allow a plurality of adjacent support structures to be connected and an assembly thereof to be rolled up.

6. The support structure of claim 1, wherein the base is substantially rectangular.

7. The support structure of claim 1, wherein the base has openings for water drainage.

8. The support structure of claim 1, wherein the tabs within said sets of a plurality of tabs are separated by substantially V-shaped spaces.

9. The support structure of claim 1, wherein the struts are relatively tall in comparison with their width.

10. The support structure of claim 1, wherein at least one of the struts spans the space between the two said sets of a plurality of tabs.

11. The support structure of claim 1, further comprising connectors for attaching adjoining support structures to each other.

12. The support structure of claim 11 wherein the connectors are adapted to allow a plurality of adjacent support structures to be connected and an assembly thereof to be rolled up.

13. The support structure of claim 11 wherein the connectors comprise snaps.

14. The support structure of claim 3, wherein the height of a plurality of said tabs above said base is greater than the distance separating said plurality of tabs at said base.

* * * * *